United States Patent [19]

Peterson et al.

[11] 4,253,276

[45] Mar. 3, 1981

[54] OPERATOR FOR A CASEMENT-TYPE WINDOW

[75] Inventors: Jeffory A. Peterson, Canby; Eric W. Nelson, Minneapolis, both of Minn.

[73] Assignee: Truth Incorporated, Owatonna, Minn.

[21] Appl. No.: 44,003

[22] Filed: May 31, 1979

[51] Int. Cl.[3] ..... E05D 15/28

[52] U.S. Cl. ..... 49/249; 49/260; 49/342; 49/345

[58] Field of Search ..... 49/246, 248–253, 49/260, 261, 346, 345, 341–343, 324

[56] References Cited

U.S. PATENT DOCUMENTS

| | | | |
|---|---|---|---|
| 2,366,613 | 1/1945 | Hagstrom | 49/252 |
| 2,726,082 | 12/1955 | Ziesmer | 49/249 |
| 2,824,735 | 2/1958 | Stavenau et al. | 49/324 |
| 2,948,027 | 8/1960 | Gill, Jr. et al. | 49/425 |
| 2,952,882 | 9/1960 | Reynaud | 49/249 |
| 3,438,151 | 4/1969 | Evers et al. | 49/345 |

*Primary Examiner*—Philip C. Kannan

*Attorney, Agent, or Firm*—Wegner, Stellman, McCord, et al.

[57] ABSTRACT

An operator for a casement-type window sash which is mounted adjacent one edge thereof on slider structure for combined pivoting and linear movement comprising, a first structure for causing said combined pivoting and linear movement including a first linkage having an operating arm and a connecting link which is pivotally connected to the operating arm intermediate the ends thereof and also pivotally connected to said sash and a constraining link pivotally connected to a window sill and to the sash at a distance from said edge. A member mounted at an end of the operating arm at a distance from said pivotal connection to the connecting link and movable in an arc as the operating arm moves between window open and closed positions and a channel member mounted on the sash to extend lengthwise thereof and at a location to confine and be engaged by said member when the sash is either closed or partially open or at any position therebetween function to assist in closing and opening of the sash and holding the sash in a partially open position.

7 Claims, 3 Drawing Figures

OPERATOR FOR A CASEMENT-TYPE WINDOW

BACKGROUND OF THE INVENTION

This invention pertains to an operator for a casement-type window which causes the window sash to move between open and closed positions and wherein the operator has torque performance advantages in opening and closing of the window as well as better action in holding of the window in a fixed, partially open position.

Operators for casement-type windows are known in the art wherein linkage connected between the window frame and the window sash move the window sash between open and closed positions by a combined pivoting and linear movement. In opening movement of the window sash, one edge thereof is caused to move outwardly from the window frame, while the other edge of the window, which is suitable supported by slider structure at the top and bottom thereof, is caused to move linearly in a path parallel to the window sill and, at the same time, pivoting is permitted. Typically, the prior art operators have had linkage structure which is incapable of exerting substantial force during final closing movement of the window sash or upon initial opening thereof. In order to overcome these deficiencies, there is an operator, as shown in Evers U.S. Pat. No. 3,438,151 which has added structure to assist in final closing of the window and also to assist in initial opening thereof. The assist structure shown in the Evers patent is only effective during a very limited range of movement of the window sash toward and away from the final closed position.

A relatively complex structure of an operator for a casement-type window is shown in Hagstrom U.S. Pat. No. 2,366,613 wherein threaded members transport structure which supports the window sash and a separate member operable by the transport structure provides torque assistance in opening and closing of the window. The Hagstrom structure is complex and bulky and does not disclose a practical solution to a low-cost operator for a casement-type window.

SUMMARY OF THE INVENTION

A primary feature of the invention disclosed herein is to provide an operator for a casement-type window which provides significant torque performance advantages over existing operators, provides more control of the window sash and easier operation near the closed position, and which minimizes chattering of the window sash in a partially open condition under resonant wind conditions.

An object of the invention is to provide an operator having the foregoing features and having means including a first linkage having an operating arm and a connecting link pivotally connected to the operating arm intermediate the ends thereof and pivotally connected to the sash, and means for assisting said first-mentioned means in closing and opening of the sash and holding the sash in a partially open position comprising a member mounted at an end of the operating arm at a distance from the pivotal connection to the connecting link and movable in an arc as said operating arm moves between window open and closed positions, and a member mounted on the sash to extend lengthwise thereof at a location to confine and be engaged by said member when the sash is either closed or partially open or at any position therebetween.

Another object of the invention is to provide an operator as defined in the preceding paragraph wherein said member on the sash is a channel member and the member on the operating arm is a roller with said roller being movable within said channel member during part of sash movement to and from fully closed position to provide, with the operating arm, a torque action in opening and closing the window sash. The roller is retained in the channel member in opening of the window sash to a partially open position whereby the window sash has less freedom to move with resulting greater control of the window sash which minimizes chattering of the sash in resonant wind conditions. With further opening movement of the window sash beyond said partially open position, the roller leaves the channel member to permit a full opening movement of the window sash.

DESCRIPTION OF THE PREFERRED EMBODIMENT

Figures 1, 2:
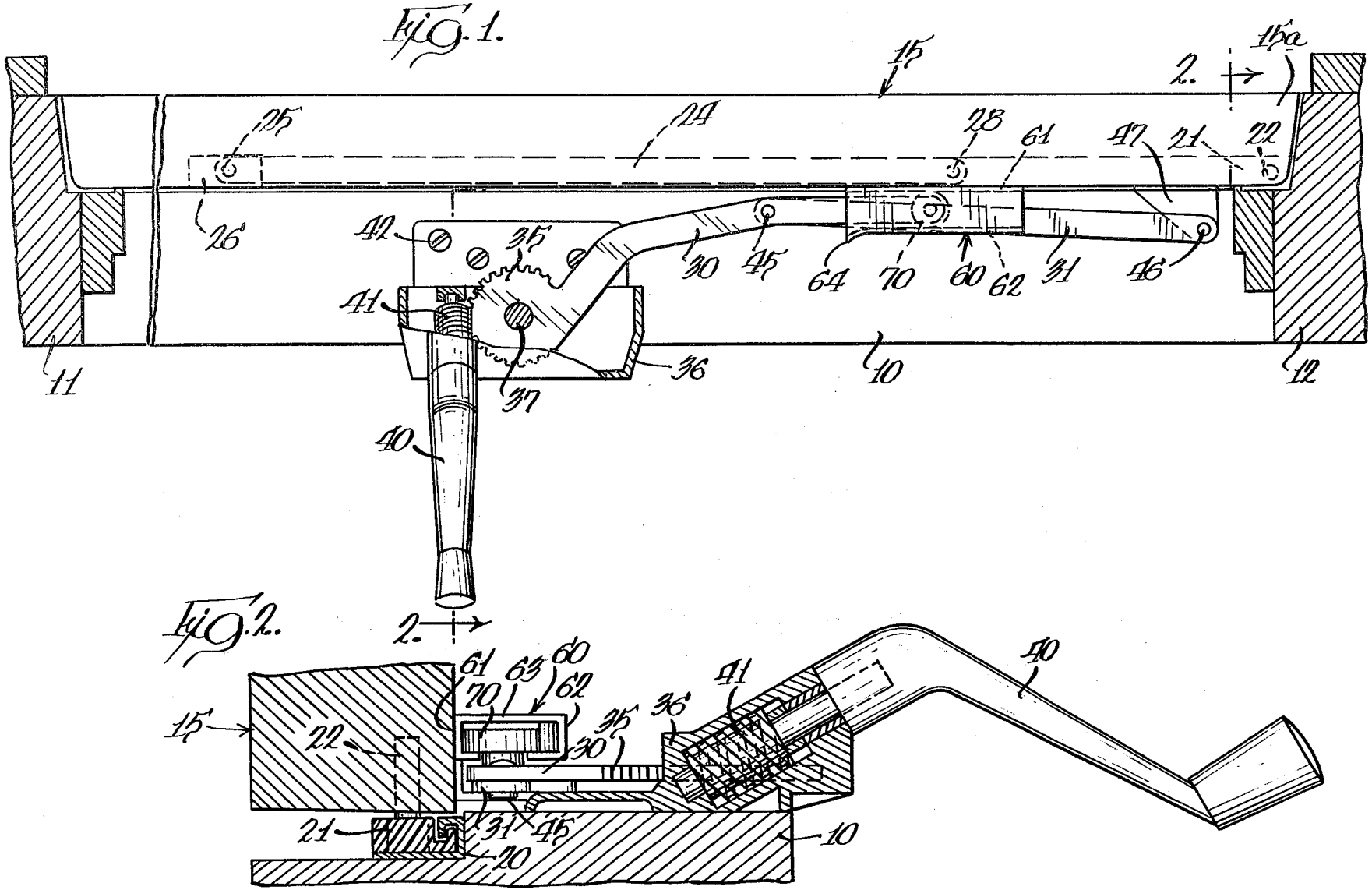
FIG. 1 is a plan section of a window and the operator with parts broken away.
FIG. 2 is a vertical section, on an enlarged scale, taken generally along the line 2—2 in FIG. 1.

A casement-type window is shown generally in the Figures wherein a window frame has a sill 10 and a pair of side jambs 11 and 12 which extend upwardly to a head (not shown). The window sash is indicated generally at 15 and is mounted within the frame for combined linear and pivoting movement between the closed position shown in FIG. 1 and a fully open position, shown in full line in FIG. 3. This movement of the sash is permitted by mounting structure therefor located at both top and bottom of the sash and with the structure associated with the bottom of the sash shown particularly in the drawings. The sill 10 mounts an elongated track member 20 to receive a slider structure 21 which slidably interengages with the track member 20 and which is pivotally connected to the sash at one sash edge **15*a* by a mounting pin 22. An example of a slider structure and track member suitable for use is shown in Gill U.S. Pat. No. 2,948,027 and reference may be made thereto for a more detailed understanding of this type of structure. A similar slider structure and track member are located at the head of the frame and the top of the window sash, as shown in the Gill patent, to provide for secure mounting of the window sash. These structures enable said one edge of the window sash to move linearly in a direction parallel to the length of the window sill 10 while the opposite edge of the window sash can pivot outwardly from the closed position, shown in FIG. 1, to the fully open position of FIG. 3**.

A constraining link 24 to control the path of sash movement is pivotally connected at 25 to a mounting plate 26 secured to the window sill 10 by attaching means 27 and has its other end pivotally connected to the underside of the lower rail of the window sash, as shown at 28.

Means for moving the window sash comprises an operating linkage including a pivotable operating arm 30 and a connecting link 31. The operating arm 30 has an end formed as a gear sector 35 and which is pivotally mounted within a casing 36 of a standard operator assembly by means of a pivot pin 37.

Figure 3:
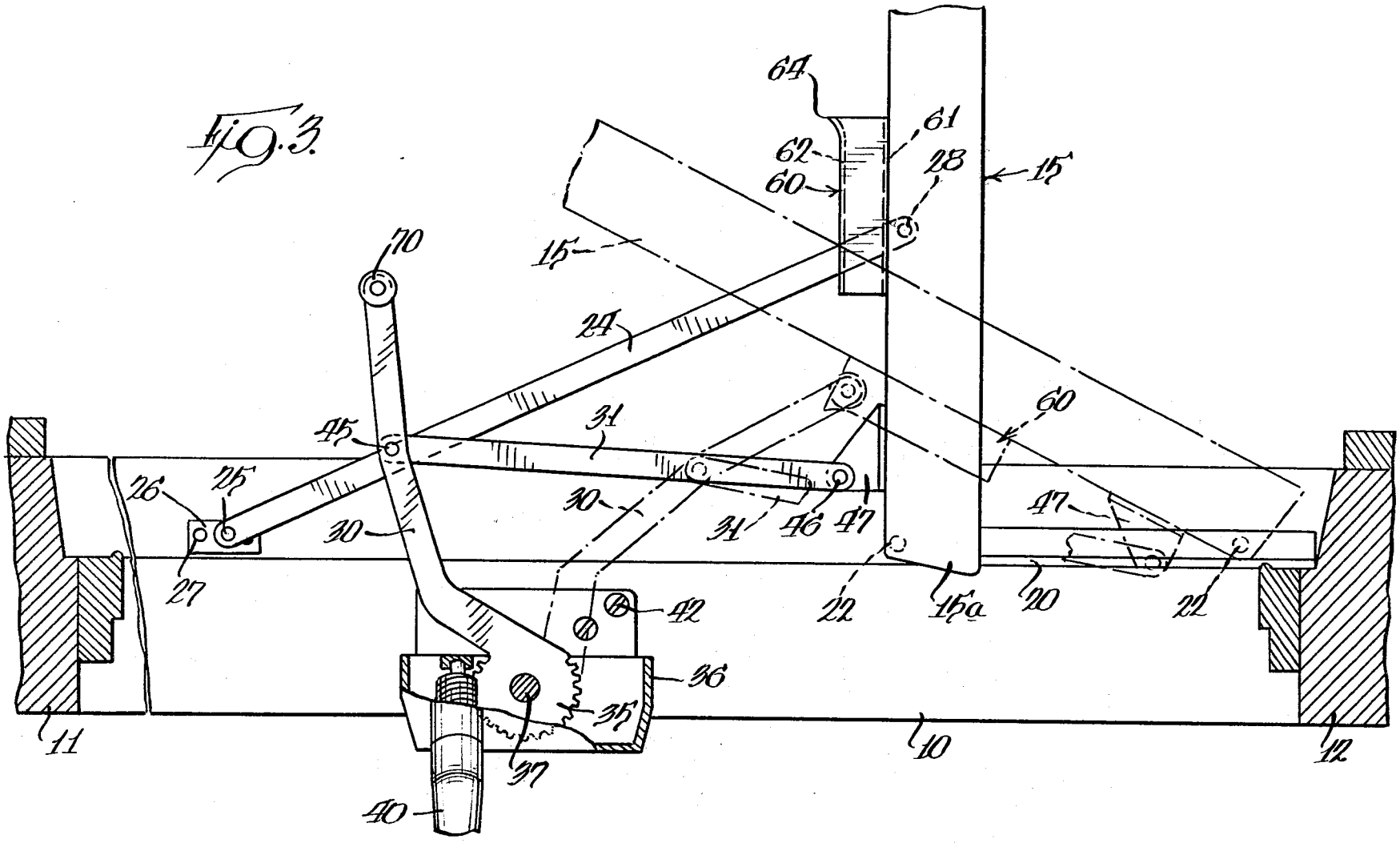
FIG. 3 is a view, similar to FIG. 1, showing the window sash fully open in full line and partially open in broken line.

A rotatable crank, or handle, 40 is manually operable to rotate a worm 41 which engages the worm gear section 35 for pivoting of the operating arm 30 between the retracted position, shown in FIG. 1, and the fully extended position, shown in FIG. 3. The standard operator assembly is mounted on the window sill 10 by suitable attaching members 42. The connecting link 31 is pivotally connected at one of its ends to the operating arm 30 intermediate its ends, as shown at 45, with the other end of the connecting link being pivoted at 46 to a mounting member 47 which is connected to the lower rail of the sash adjacent the sash edge which is pivotally connected to the slider structure.

With the window closed, the window sash is in the position shown in FIG. 1. Rotation of the handle 40 results in outward movement of the operating arm 30 which, through the connecting link 31, exerts a pull on sash edge 15*a* to move the sash edge linearly in a direction parallel to the window sill while, at the same time, the constraining link 24 is moving from a position extending parallel to the window sill to an outward position which results in outward pivoting of the window sash. The fully-extended position of the operating linkage is shown in full line in FIG. 3. Rotation of the handle 40 in the opposite direction will cause a reversal of the action to bring the window sash back into closed relation with the window frame.

Means for assisting the operating linkage in causing opening and closing movement of the sash and holding the sash in a partially open position includes a channel member, indicated generally at 60, which is secured to the lower rail of the window sash at a distance from the linearly moving edge thereof and which has a pair of side walls 61 and 62 interconnected by a planar section 63 which define an open-ended channel and with the wall 62 having a flared-out end 64.

A member 70, in the form of a roller which is of a diameter only slightly less than the distance between the walls 61 and 62 of the channel member, is carried at an end of the operating arm 30 at a distance from the pivot connection 45 for coaction with the channel member 60. With the window closed, the roller 70 is within the channel member 60, as shown in FIG. 1. As the handle 40 is rotated to cause the movement of the operating arm 30, as previously described, the roller 70 acts on the wall 61 of the channel member to push on the lower rail of the sash at a distance from the linearly moving edge 15*a* thereof whereby the window sash is actually torqued-open by the roller 70 pushing thereon and the connecting link 31 pulling adjacent the edge of the sash. The roller 70 continues to coact with the channel member 60 to a partially-open position of approximately 30° and approximating the position shown in broken line in FIG. 3. This continued coaction between the roller 70 and the channel member 60 maximizes control of the window sash with relatively little freedom for movement of the window sash. This close control minimizes chattering of the window sash which normally can occur in resonant wind conditions.

Beyond the partially-open position shown in FIG. 3, the roller 70 continues to move in an arc which moves it away from the sash and the channel member 60 until the parts reach the fully open position shown in full line in FIG. 3.

Closing movement of the window from the position of the sash shown in FIG. 3 progressively moves the sash inward until the parts are again in the broken line position of FIG. 3 and with the roller 70 entering into the channel member 60 as facilitated by the flared end 64 of the wall 62. Further closing movement again results in a torque action by the connecting link 31 pushing against an edge of the window sash and the roller 70 pushing against the wall 62 of the channel member. This action continues until the parts move to the fully retracted and window sash closed position shown in FIG. 1 wherein the operating arm 30 and connecting link 31 extend in generally parallel overlapped relation with the window sill 10.

With the structure disclosed herein, there is good, positive control of movement of the window sash between closed and partially open position because of the added continuing engagement between the roller 70 and the connecting member 60. The parts are dimensioned to have the operating arm 30, connecting link 31 and constraining link 32 provide good force transmission angles throughout the window operation and the operating arm 30 is then shaped and the roller 70 located relative to the channel member 60 to provide for the degree and range of contact therebetween for the desired operation. In the embodiment shown, the operating arm 30 is not straight, but has a slight bend intermediate its ends.

With the structure disclosed herein, good initial opening and final closing movement of the window sash is obtained and also a more positive control of the window sash between closed and partially open position as long as the roller 70 is engaged within the channel member 60.

We claim:

1. An operator for a casement-type window comprising, a sash and a frame with a slider structure therebetween enabling combined pivoting and linear movement of the sash, operating linkage for imparting opening and closing movement to said sash including a pivotable operating arm, a link connecting the operating arm with the sash, said connecting link being pivoted at one end to said operating arm intermediate the ends thereof and pivoted at the other end to a fixed location on the sash, a constraining link connected between the frame and sash for controlling sash movement, a roller mounted at an end of said operating arm, and a channel member mounted on said sash to receive said roller and having a length to only be engaged by said roller when said sash is located at or between closed and partially open positions.

2. An operator as defined in claim 1 wherein said channel member, said operating arm and said connecting link are all positioned generally parallel to said sash and in overlapped relation when said sash is closed.

3. An operator as defined in claim 1 wherein said roller moves in an arc as said operating arm pivots to cause movement of the sash, and said channel member having an open end and a length to be engaged by said roller when the sash is closed and until the sash has moved partially open to an angle of approximately 30°, the arc of the roller carrying the roller out of and away from the channel member as the sash is moved further open beyond said partially open position.

4. An operator for a casement-type window sash which is mounted adjacent one edge thereof on slider structure for combined pivoting and linear movement in a window frame comprising, means for causing said combined pivoting and linear movement including a first linkage including an operating arm and a connecting link pivotally connected to said operating arm intermediate the ends thereof and pivotally connected to said sash and a constraining link pivotally connected to said window frame and to said sash at a distance from said edge, and means for assisting said first-mentioned means in closing and opening of said sash and holding said sash in a partially open position comprising, a member mounted at an end of said operating arm at a distance from said pivotal connection to the connecting link and movable in an arc as said operating arm moves between window open and closed positions, and a member mounted on said sash to extend lengthwise thereof and at a location to confine and be engaged by said member when the sash is either closed or partially open or at any position therebetween.

5. An operator for a casement-type window sash which is mounted in a window frame for combined pivoting and linear movement comprising, a first linkage including an operating arm and a connecting link pivotally connected to said operating arm intermediate the ends thereof and pivotally connected to the window sash, a constraining link pivotally connectable to said window frame and to said sash at a distance from said edge, a channel member mountable on said sash to extend lengthwise of the sash bottom rail, and a member mounted at an end of said operating arm at a distance from said pivotal connection to the connecting link and movable in an arc between extended and retracted positions as said operating arm moves between window open and closed positions, respectively, and engageable with said channel member to assist in initial opening and final closing of said sash.

6. An operator for a casement-type window sash which is mounted adjacent one edge thereof on slider structure for combined pivoting and linear movement relative to a window frame comprising, a first linkage including an operating arm and a connecting link pivotally connected to said operating arm intermediate the ends thereof, an operator assembly mountable on a window sill for imparting pivotal movement to said operating arm, means pivotally connecting an end of the connecting link to said sash adjacent said edge thereof, a contraining link pivotally connected to said window frame and to said sash at a distance from said edge, a roller mounted at an end of said operating arm at a distance from said pivotal connection to the connecting link and movable in an arc between extended and retracted positions as said window sash moves between open and closed positions, respectively, and a channel member mounted on the bottom rail of said sash to extend lengthwise thereof and at a location to confine and be engaged by said roller when said window sash is closed and partially open.

7. An operator for a casement-type window sash which is mounted for combined pivoting and linear movement comprising, a first linkage including an operating arm and a connecting link pivotally connected to said operating arm intermediate the ends thereof, a roller mounted at an end of said operating arm at a distance from said pivotal connection to the connecting link and movable in an arc between extended and retracted positions as said operating arm moves between window open and closed positions, respectively, and a channel member mountable on said sash to extend lengthwise of the sash bottom rail and at a location to confine and be engaged by said roller for a part of the roller arc of travel adjacent said retracted position and at said retracted position.

* * * * *